US006318424B1

(12) United States Patent
Elfrink

(10) Patent No.: US 6,318,424 B1
(45) Date of Patent: Nov. 20, 2001

(54) MULTI-PURPOSE HYDRAULIC PRESS, METAL BENDING, AND LOG SPLITTING APPARATUS

(76) Inventor: Herman F. Elfrink, 994 E. Turkeyfoot Lake Rd., Akron, OH (US) 44312

( * ) Notice: Subject to any disclaimer, the term of this patent is extended or adjusted under 35 U.S.C. 154(b) by 0 days.

(21) Appl. No.: 09/799,162

(22) Filed: Mar. 5, 2001

(51) Int. Cl.[7] ..... B27L 7/00

(52) U.S. Cl. ..... 144/195.1; 29/560; 72/389.1; 83/690; 144/3.1; 144/193.1; 144/366

(58) Field of Search ..... 29/560; 83/658, 83/639.1, 690, 859; 72/389.1, 389.6, 389.7; 144/2.1, 193.1, 195.1, 195.9, 3.1, 366

(56) References Cited

U.S. PATENT DOCUMENTS

| | | | | |
|---|---|---|---|---|
| 2,006,889 | * | 7/1935 | Frommherz | 29/560 |
| 4,111,246 | | 9/1978 | La Pointe . | |
| 4,131,403 | | 12/1978 | Keith, Jr. . | |
| 4,153,088 | | 5/1979 | King et al. . | |
| 4,300,605 | | 11/1981 | Pierrat . | |
| 4,304,540 | | 12/1981 | Hammon . | |
| 4,403,635 | | 9/1983 | York . | |
| 4,405,005 | | 9/1983 | Zanker . | |
| 4,432,402 | | 2/1984 | Wirsbinski . | |
| 4,515,194 | | 5/1985 | Dankel . | |
| 5,520,253 | | 5/1996 | Kesting . | |
| 5,535,795 | | 7/1996 | Bunn . | |
| 5,645,179 | | 7/1997 | Mohar . | |
| 5,967,206 | | 10/1999 | Milton . | |
| 6,085,570 | * | 7/2000 | Preaus | 72/389.7 |

* cited by examiner

*Primary Examiner*—W Donald Bray
(74) *Attorney, Agent, or Firm*—John D. Gugliotta

(57) ABSTRACT

A multi-purpose hydraulic press, metal bending, and log splitting apparatus is disclosed. An hydraulic ram, having a piston cylinder for extending and retracting a piston rod driven by an hydraulic power means, is rigidly affixed to an elongated I-beam frame member, the central portion of which spans a throat area bounded on one side by the hydraulic ram and on the opposite side by a rigidly attached foot plate. The foot plate is formed of a planar steel member affixed perpendicularly to the frame member, and forms a ram extension penetration orifice within the plane of the plate in a position aligned with the piston rod. A series of functional inserts are included for placement against the foot plate or piston rod. A series of functional extension elements are also included for placement against the piston rod for extension through the ram extension penetration orifice. These functional extensions thereby allow the apparatus to be adapted to transmit its hydraulic ram capacity outward, in a controllable fashion, past the working throat of the apparatus.

18 Claims, 6 Drawing Sheets

MULTI-PURPOSE HYDRAULIC PRESS, METAL BENDING, AND LOG SPLITTING APPARATUS

RELATED APPLICATIONS

There are no previously filed, nor currently any co-pending applications, anywhere in the world.

BACKGROUND OF THE INVENTION

1. Field of the Invention

The present invention relates generally to log splitting apparatus and, more particularly, to methods of adapting an otherwise conventional log splitter for purposes of multiple, extending applications.

2. Description of the Related Art

As is well-known in the art, hydraulic log splitters are well know and widely available. They are reliable, well made, provide a great capacity of hydraulic force, can be made portable, and, due to their popularity, are reasonable in price and availability. In fact, most equipment rental facilities can provide such a tool for a limited time and for a very deminimus price. Although many different brands are available, each with minor modifications relative to one another, all have some similar basic functional features. For example, a hydraulic power means has been shown to be an effective source of power for purposes of splitting logs. Therefore, most log splitters have a motor driving a hydraulic pump that drives a hydraulic ram. The hydraulic ram is aligned along a rigid support frame with a splitting wedge such that logs placed between the ram and wedge are impinged there between.

Many minor adaptations of this arrangement are known. These include adding the wedge to the end of the ram, differing power requirements, pivoting the frame rail vertical, mounting the entire assembly on a portable housing, and others. Although these many adaptations are known, they remain minor variations on the basic theme. This is due, in part, to the fact that the basic arrangement of a conventional log splitter is a very well adapted tool design for accomplishing its particular task.

The only problem occurs from the design of the log splitter is that it is, in fact, particularly well adapted for splitting logs, and cannot easily be modified into a more general purpose tool.

Any attempts that have been made to make the log splitter into a general purpose tool have inevitably resulted in deterioration of its functionality as a particular purpose tool. A search of the prior art did not disclose any patents that read directly on the claims of the instant invention; however, the following references were considered related.

U.S. Pat. No. 5,645,179, issued in the name of Mohar, discloses a multiple implement equipment boom that allows a log splitter or other type of implement to be affixed to a tractor or similar vehicle.

U.S. Pat. No. 4,405,005, issued in the name of Zanker, discloses a firewood splitter that allows for manual splitting of logs.

U.S. Pat. No. 5,535,795, issued in the name of Bunn, discloses a log splitting attachment for a hand jack tat allows the portable, hand split logs using a ratcheting jack mechanism.

U.S. Pat. No. 5,520,253, issued in the name of Kesting, discloses custom assembled equipment for landscaping that allows a number of attachments and implements to be powered by a device similar to a conventional garden rototiller.

U.S. Pat. No. 4,403,635, issued in the name of York, discloses a powered wood splitter with multiple work heads that splits wood using two rotating, bladed cones.

U.S. Pat. No. 4,131,403, issued in the name of Keith, Jr., discloses a mounting press that provides a hydraulic press mechanism that includes a removable, hydraulic jack as a power transmission mechanism.

U.S. Pat. No. 4,304,540, issued in the name of Hammon, discloses a hydraulic press that uses a short stroke piston assembly to drive the press platen in a coordinated fashion.

U.S. Pat. No. 4,153,088, issued in the name of King et al., discloses a hydraulic log splitter attachment for farm tractors and industrial tractors using a fixed wedge and a hydraulic ram powered by a PTO attachment to the tractor.

U.S. Pat. No. 4,300,605, issued in the name of Pierrat, discloses a log splitter having a fixed wedge and a ram that is guided against rotational or pivotal twisting.

U.S. Pat. No. 4,432,402, issued in the name of Wirsbinski, discloses a self-elevating wood splitter having a self-contained means for rasing or lowering the machine.

U.S. Pat. No. 4,515,194, issued in the name of Dankel, discloses a log splitter having a serviceable wedge assembly in which wedge tip sections can be removably replaced.

And, U.S. Pat. No. 5,967,206, issued in the name of Milton, discloses a hydraulic log splitter with drag hoist having a clampable hoist for grappling and dragging logs and pulling them to the splitter mechanism.

Consequently, a need has been felt for providing an apparatus and method which provides all the functionality currently available in a conventional log splitter, without any deterioration in performance, while at the same time allows for expanding and broadening the use for other functions that also require a great capacity of hydraulic force.

SUMMARY OF THE INVENTION

It is therefore an object of the present invention to provide methods of adapting an otherwise conventional log splitter for purposes of multiple, extending applications.

It is a feature of the present invention to provide an improved log splitting apparatus that can be adapted to fulfill other pressing, bending, splitting or forming functions within the working throat of the apparatus.

It is another feature of the present invention to provide a log splitting apparatus that can be adapted to transmit its hydraulic ram capacity outward, in a controllable fashion, past the working troat of the apparatus.

Briefly described according to the preferred embodiment of the present invention, a multi-purpose hydraulic press, metal bending, and log splitting apparatus is disclosed. An hydraulic ram, having a piston cylinder for extending and retracting a piston rod driven by an hydraulic power means, is rigidly affixed to an elongated I-beam frame member, the central portion of which spans a throat area bounded on one side by the hydraulic ram and on the opposite side by a rigidly attached foot plate. The foot plate is formed of a planar steel member affixed perpendicularly to the frame member, and forms a ram extension penetration orifice within the plane of the plate in a position aligned with the piston rod. A series of functional inserts are included for placement against the foot plate or piston rod. A wedge shaped insert will allow the device to function as an otherwise conventional log splitter would function. Other more specialized inserts allow the device to be adapted to bend metal, such as pipes, conduit, rebar, or metal strips, or to flatten metal for function otherwise as a multipurpose press.

A series of functional extension elements are also included for placement against the piston rod for extension through the ram extension penetration orifice. These functional extensions thereby allow the apparatus to be adapted to transmit its hydraulic ram capacity outward, in a controllable fashion, past the working throat of the apparatus. This can be useful for pressing, pulling, punching, shearing, coping, notching, crimping, pumping, mortising, drilling, broaching, stamping, peening, crushing, compacting, or lifting and retrieveal operations, as well as for bending or flattening metal or demolishing structures that are too large or immobile to be placed within the working throat area of the device. Additional anticipated uses with minor modification include as a welding or cutting guide for oxyacetylene torches or plasma cutter. Other additional anticipated uses with minor modifications include chain puller, jack spreader, controlled rigging, or steel flaring and hose crimping.

An advantage of the present invention is that it can provide all of the functionality of an otherwise conventional log splitter.

Another advantage of the present invention is that it can allow for application of hydraulic force within the throat area of the device for purposes other than splitting logs.

Yet another advantage of the present invention is that is can allow for transmission of hydraulic force to areas outside the throat area of the device.

Further, a preferred embodiment of the present invention can be made portable, adaptable, and as reasonably priced as conventionally available log splitter.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of an otherwise conventional log splitter. In such a log splitter, an elongated I-beam frame member is generally used to support a log to be spilt, and includes a wedge assembly mounted at one end thereof and a log moving frame mounted at the opposite end. Various sizes of hydraulic rams can be accommodated in this fashion, depending upon desired capacity, and a conventional internal combustion engine powers the hydraulic pump to drive the hydraulic ram in or out, A control lever, usually mounted at or near the hydraulic ram, allows hydraulic fluid to be directed to cause the ram to move in, out, or not at all. For units of significant capacity, a trailer means is usually built directly onto the I-beam frame member, which can also allow for a pivoting connection that allows the I-beam frame member to be mounted vertically or horizontally, depending upon the needed splitting position. Many other options and modifications, such as support plates to hold workstock within the throat area, are also known.

The best mode for carrying out the invention is presented in terms of its preferred embodiment, herein depicted within the Figures.

1. Detailed Description of the Figures

Figure 1:
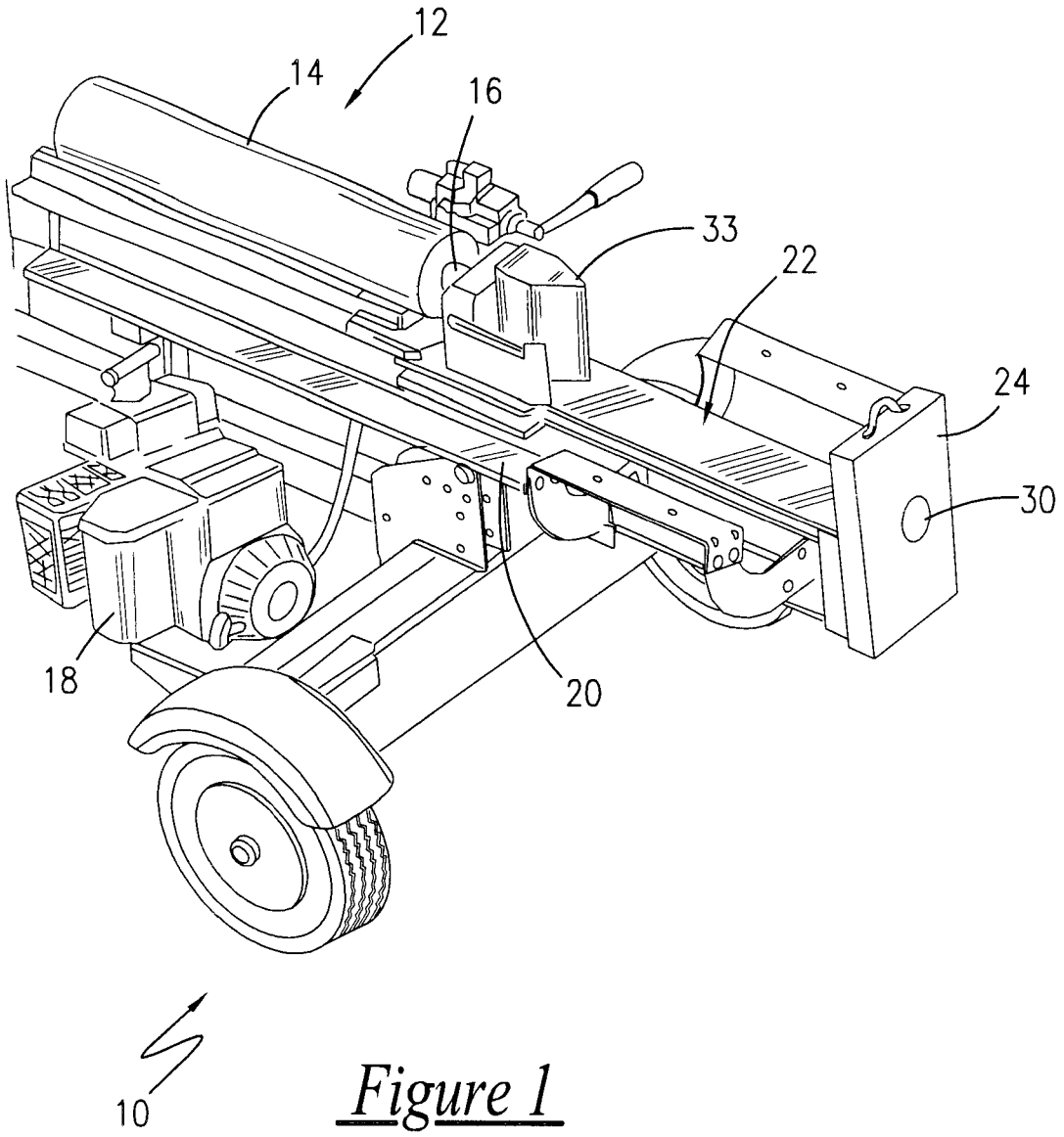
FIG. 1 is a perspective view of a multi-purpose hydraulic press, metal bending, and log splitting apparatus according to the preferred embodiment of the present invention.

Referring now to FIG. 1, a perspective view of a multi-purpose hydraulic press, metal bending, and log splitting apparatus 10 is shown, according to the present invention. An hydraulic ram 12, having a piston cylinder 14 for extending and retracting a piston rod 16 driven by an hydraulic power means 18, is rigidly affixed to an elongated I-beam frame member 20, the central portion of which spans a throat area 22 bounded on one side by the hydraulic ram 12 and on the opposite side by a rigidly attached foot plate 24. The foot plate 24 is formed of a planar steel member affixed perpendicularly to the frame member 20, and forms a ram extension penetration orifice 30 within the plane of the plate 24 in a position aligned with the piston rod 16.

Figure 2:
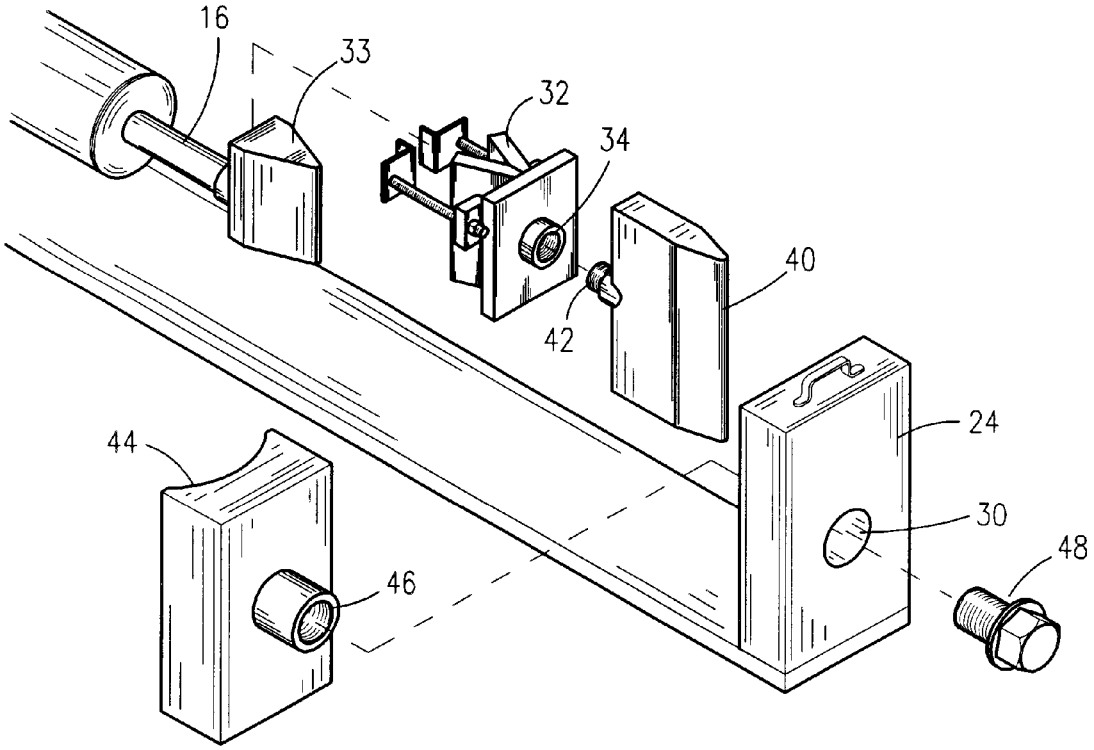
FIG. 2 is an exploded perspective view thereof, shown including a metal press brake die insert for use therewith to allow the apparatus to be adapted to fulfill other pressing, bending, splitting or forming functions within the working throat of the apparatus.
Figure 3:
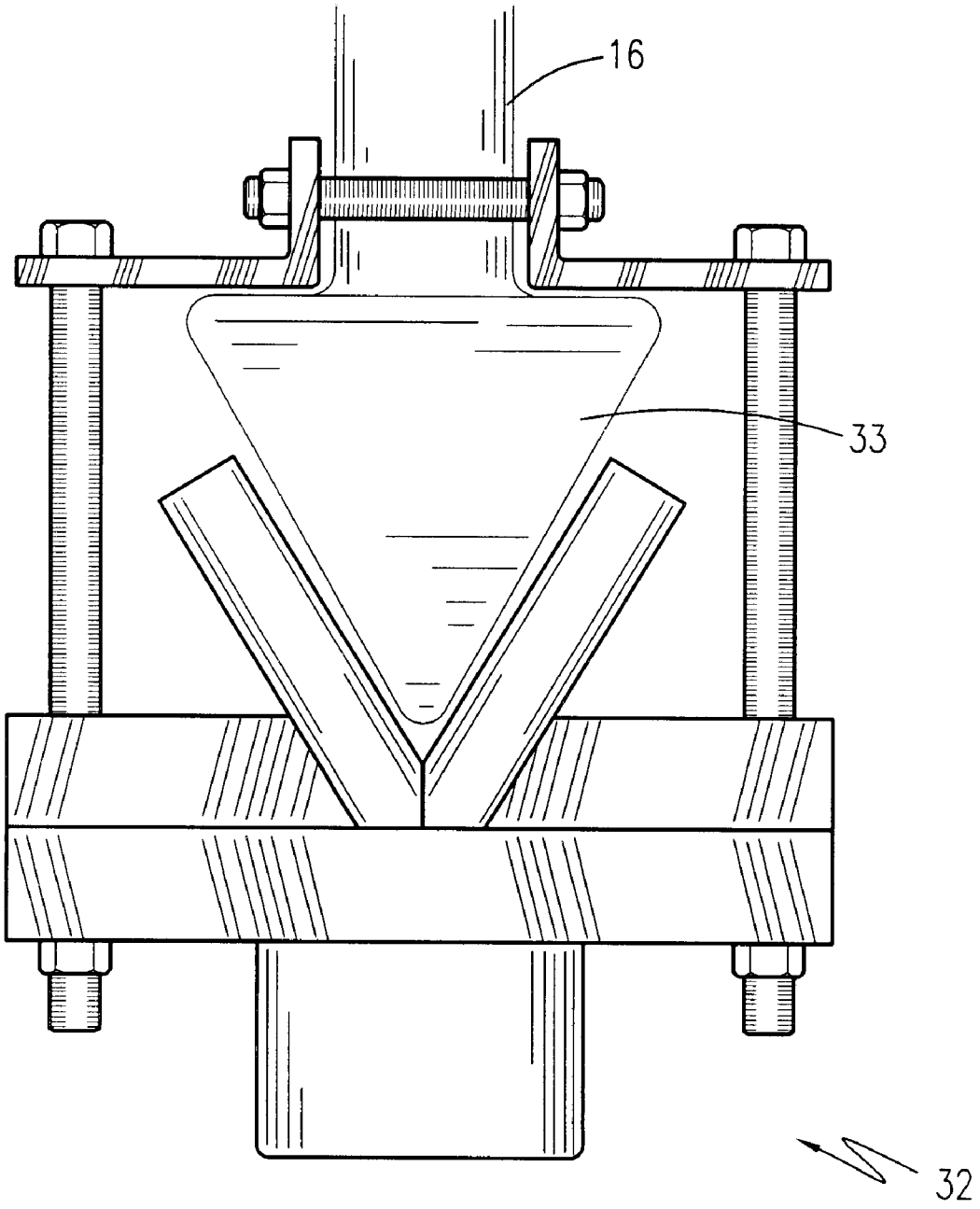
FIG. 3 is a top plan view of an attachment saddle as being mounted to the wedge of a conventional log splitter as a means of providing a surface to which male die attachments can be mounted.

In conjunction with FIG. 2, a series of functional inserts are included for placement against the foot plate or piston rod. Particularly, an attachment saddle 32 is shown in conjunction with FIG. 3, as being mounted to the wedge 33 of a conventional log splitter as a means of providing a surface to which male die attachments can be mounted. However, it is anticipated that such a configuration is valuable for use in modifying existing styles of log splitter, and that when designed around the present invention the saddle 32 could be adapted to attache directly and removabley to the end of the piston rod 16, as would the log splitting wedge 33. Shown in particular is the attachment saddle 32 can be used to provide a wider, flat driving surface, as well as a forming a threaded receiving collar 34 for threadably engaging a male die press brake 40 or any other modified male die member. As shown herein, the male die press brake 40 is formed of a planar steel member affixed perpendicularly to a cylindrical threaded attachment rod 42. The attachment rod 42 is anticipated to engage the receiving collar 34 in an interchagneable fashion.

A female press brake die 44 attaches within the ram extension penetration orifice 30 by use of an engaging collar 46 penetrating the orifice 30 and receiving a threaded retaining connector 48.

Figure 4:
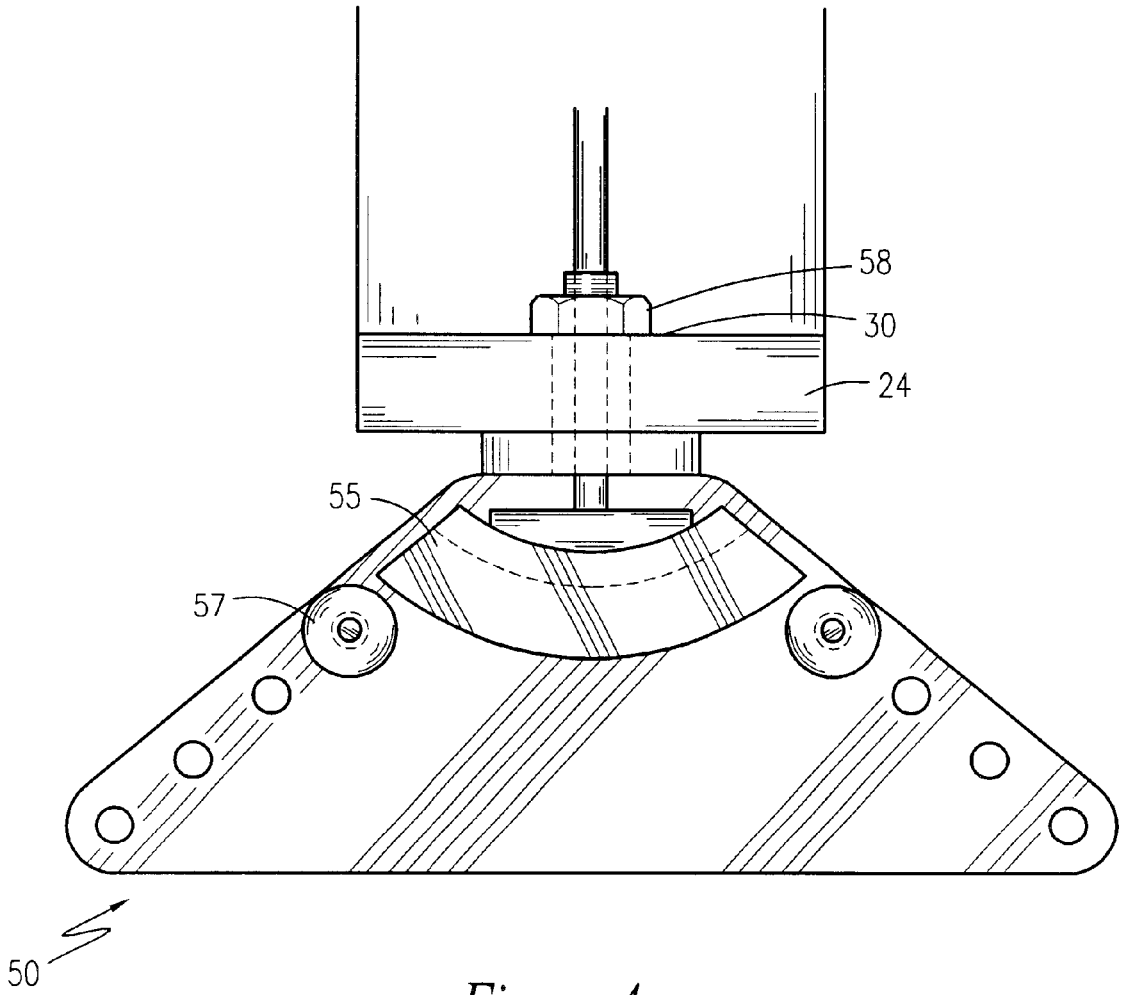
FIG. 4 is a top plan view of an pipe bending die insert as secured to the foot plate of the present invention.

Other more specialized inserts are provided for attachment to the saddle 34 that will allow the device to be adapted to bend metal, such as pipes, conduit, rebar, or metal strips, or to flatten metal for function otherwise as a multipurpose press. As shown in FIG. 4 a pipe bending die insert 50 can be secured to the foot plate 24 by placement of a securement rod 44 within the ram extension penetration orifice 30. In this manner, the pipe bending die insert 40 will attache to the foot plate affixed perpendicularly to a cylindrical receiving collar 58. Concave formed bending member 55 is thereby pushed against the tubestock to bend the pipe between receiving roller 57 as is done otherwise done with conventional specialized pipe benders.

Figure 5:
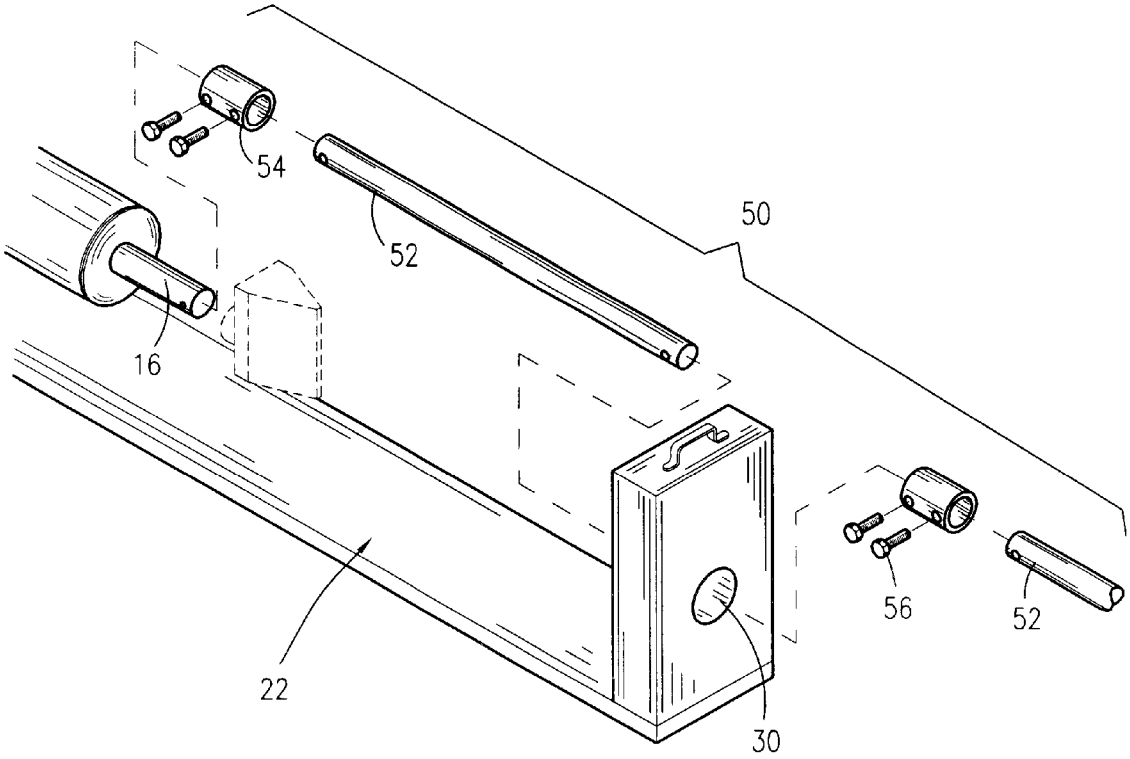
FIG. 5 is an exploded perspective view thereof, shown including a series of functional extension elements for extension through a ram extension penetration orifice to allow the apparatus to be adapted to transmit its hydraulic ram capacity outward, in a controllable fashion, past the working troat of the apparatus.
Figure 6:
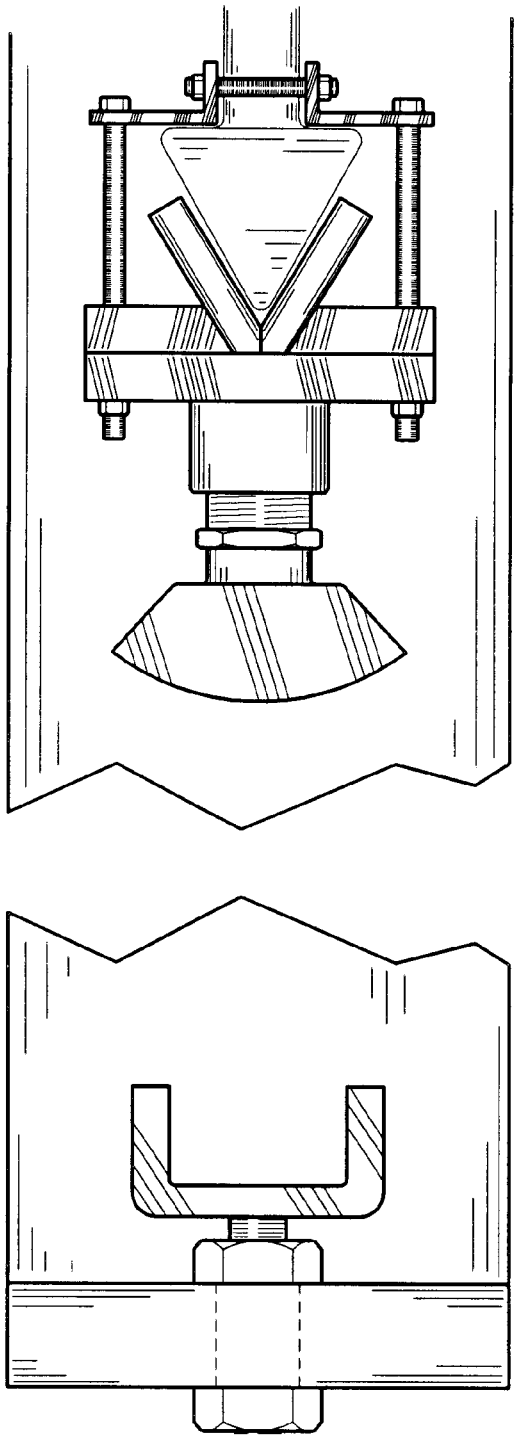
FIG. 6 is a top plan view of a bending die for use therewith.

In conjunction with FIG. 5, a series of functional extension elements 50 are also included for placement against the piston rod for extension through the ram extension penetration orifice 30. These functional extensions thereby allow the apparatus to be adapted to transmit its hydraulic ram capacity outward, in a controllable fashion, past the working troat 22 of the apparatus. This can be useful for pressing, pulling, or lifting operations, as well as for bending or flattening metal or demolishing structures that are too large or immobile to be placed within the working throat area of the device. In this manner, the ram extension penetration orifice 30 not only allows the piston 16 to access and reach areas outside the conventional working throat 22, but also acts as a guide to aid in alignment, prevent lateral motion, and keep the piston rod 16 or extension member from twisting or buckling.

Although one very long custom extension member can be utilized, it is envisioned that a series of interchangeable extensions rods 52 are used, each cylindrical, and having a cylindrical cross section equal to that of the piston rod 16 and having an overall length of approximately the same as the overall horizontal distance of the working throat area 22. A coupling means 54, formed of a hollow cylindrical coupling, can receive the end of the piston rod 16 at one end and the end of the extension rod 52 at the other. Although frictional impingement may be sufficient to hold the componentry together, it is anticipated that a removable fastening means 56, shown herein as a locking pin, can also be used to hold the extension rods 52 together, end to end, as well as hold the piston rod 16 to the extension rods 52. By forming the coupling means 54 in a manner similar in size, shape, and construction to each receiving collar 48, the functional inserts as described in conjunction with FIG. 2 can be used in concert with the series of functional extension elements 50 as described in conjunction with FIG. 3, thereby providing an apparatus and method which provides all the functionality currently available in a conventional log splitter, without any deterioration in performance, while at the same time allows for expanding and broadening the use for other functions that also require a great capacity of hydraulic force.

2. Operation of the Present Invention

To use the present invention for purposes of metal forming, pipe bending, pressing or flattening, many different types of functional inserts of the type similar to those described above can be used, each adapted specifically for a specific purpose. In this fashion, the cost and complications of making a specific purpose tool, such as a pipe bender or a log splitter, can be limited to the design, construction, function and cost of the inserts, while the means for providing a great capacity of hydraulic force can be integrated with the technology readily available and commercially achievable that exists within a log splitter type apparatus.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A multi-purpose hydraulic press, metal bending, and log splitting apparatus comprising:

an hydraulic ram having a piston cylinder for extending and retracting a piston rod driven by an hydraulic power means;

an elongated I-beam frame member rigidly affixed to said ram and having a central portion of which spans a throat area;

said throat bounded on one side by said hydraulic ram and on an opposite side by a rigidly attached foot plate; and said foot plate affixed perpendicularly to the frame member and forming a ram extension penetration orifice within a plane of the plate in a position aligned with the piston rod.

2. The apparatus of claim 1, further comprising a removable functional insert for placement against said foot plate and said piston rod.

3. The apparatus of claim 2, wherein said functional insert includes an attachment saddle.

4. The apparatus of claim 2, wherein said attachment saddle forms a threaded receiving collar for threadably engaging a modified male die member in an interchangeable fashion.

5. The apparatus of claim 2, wherein a female press brake die attaches within the ram extension penetration orifice by use of an engaging collar penetrating the orifice and receiving a threaded retaining connector.

6. The apparatus of claim 1, further comprising a pipe bending die insert to be secured to the foot plate by placement of a securement rod within the ram extension penetration orifice, wherein the pipe bending die insert attaches to the foot plate affixed perpendicularly to a cylindrical receiving collar.

7. The apparatus of claim 6, wherein a concave formed bending member is thereby pushed against the tubestock to bend the pipe between receiving roller as is done otherwise done with conventional specialized pipe benders.

8. The apparatus of claim 1, further comprising functional extension elements for placement against the piston rod for extension through the ram extension penetration orifice.

9. The apparatus of claim 8, wherein said functional extensions thereby allow the apparatus to be adapted to transmit its hydraulic ram capacity outward, in a controllable fashion, past the working troat of the apparatus.

10. The apparatus of claim 8, wherein said functional extensions comprise:

a series of interchangeable extensions rods, each cylindrical, and having a cylindrical cross section equal to that of the piston rod and having an overall length of approximately the same as the overall horizontal distance of the working throat area; and coupling means to receive the end of the piston rod at one end and the end of the extension rod at the other.

11. In an otherwise conventional hydraulic log splitter having an hydraulic ram having a piston cylinder for extending and retracting a piston rod driven by an hydraulic power means, said ram having a central portion of which spans a throat area, said throat bounded on one side by said hydraulic ram and on an opposite side by a rigidly attached foot plate, said foot plate affixed perpendicularly to the frame member, wherein the improvement comprises:

a ram extension penetration orifice within a plane of the plate in a position aligned with the piston rod; and an attachment saddle being mounted to the wedge of the log splitter as a means of providing a surface to which male die attachments can be mounted.

12. In the log splitter of claim 11, wherein the improvement further comprises a removable functional insert for placement against said foot plate and said piston rod.

13. In the log splitter of claim 12, wherein said functional insert includes an attachment saddle.

14. In the log splitter of claim 13, wherein said attachment saddle forms a threaded receiving collar for threadably engaging a modified male die member in an interchangeable fashion.

15. In the log splitter of claim 14, wherein a female press brake die attaches within the ram extension penetration orifice by use of an engaging collar penetrating the orifice and receiving a threaded retaining connector.

16. In the log splitter of claim 11, wherein the improvement further comprises a pipe bending die insert to be secured to the foot plate by placement of a securement rod within the ram extension penetration orifice, wherein the pipe bending die insert attaches to the foot plate affixed perpendicularly to a cylindrical receiving collar.

17. In the log splitter of claim 11, wherein the improvement further comprises functional extension elements for placement against the piston rod for extension through the ram extension penetration orifice.

18. In the log splitter of claim 17, wherein said functional extensions thereby allow the apparatus to be adapted to transmit its hydraulic ram capacity outward, in a controllable fashion, past the working troat of the apparatus.

* * * * *